US009282619B2

(12) United States Patent
Lin

(10) Patent No.: US 9,282,619 B2
(45) Date of Patent: Mar. 8, 2016

(54) LIGHT DEVICE FOR A CEILING FAN, SWITCH DEVICE OF THE SAME, AND METHOD FOR PREVENTING ABNORMAL OPERATION OF THE LIGHT DEVICE USING THE SWITCH DEVICE

(71) Applicant: Kuo-Tsun Lin, Taichung (TW)

(72) Inventor: Kuo-Tsun Lin, Taichung (TW)

( * ) Notice: Subject to any disclaimer, the term of this patent is extended or adjusted under 35 U.S.C. 154(b) by 0 days.

(21) Appl. No.: 14/740,339

(22) Filed: Jun. 16, 2015

(65) Prior Publication Data

US 2015/0366040 A1 Dec. 17, 2015

(30) Foreign Application Priority Data

Jun. 17, 2014 (TW) ..... 103120858 A

(51) Int. Cl.

| | |
|---|---|
| ***H05B 37/00*** | (2006.01) |
| ***H05B 41/00*** | (2006.01) |
| ***H05B 37/03*** | (2006.01) |
| ***H05B 33/08*** | (2006.01) |

(52) U.S. Cl.
CPC ..... *H05B 37/03* (2013.01); *H05B 33/0887* (2013.01)

(58) Field of Classification Search
None
See application file for complete search history.

(56) References Cited

U.S. PATENT DOCUMENTS 5,365,154 A * 11/1994 Schneider et al. ..... 318/103
2015/0235552 A1* 8/2015 Cai et al. ..... 340/12.32

* cited by examiner

*Primary Examiner* — Anh Tran
(74) *Attorney, Agent, or Firm* — Trop Pruner & Hu, P.C.

(57) ABSTRACT

A light device for use with a fan device includes a light neutral terminal coupled to a neutral terminal of an AC power source and a fan neutral terminal of the fan device, a light line terminal for connection to a line terminal of the AC power source, a light control unit for light emission upon receipt of the electrical power from the light neutral terminal and the light line terminal, and a switch device coupled between the light neutral terminal and the light control unit.

12 Claims, 1 Drawing Sheet

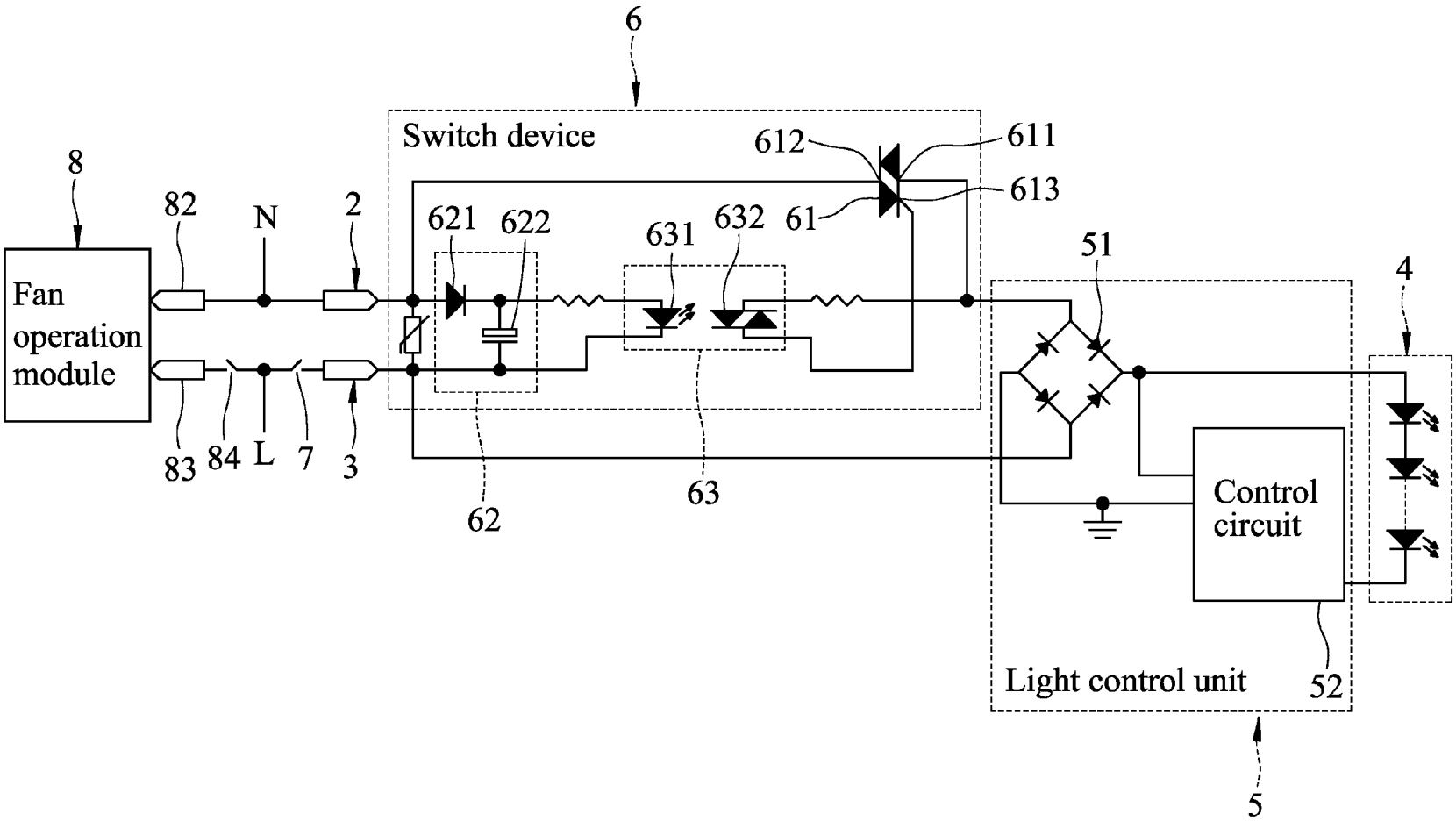
4
Control circuit
52
5
Light control unit
51
611
613
612
61
632
631
63
6
Switch device
622
621
62
2
3
7
N
L
84
82
83
8
Fan operation module

LIGHT DEVICE FOR A CEILING FAN, SWITCH DEVICE OF THE SAME, AND METHOD FOR PREVENTING ABNORMAL OPERATION OF THE LIGHT DEVICE USING THE SWITCH DEVICE

CROSS-REFERENCE TO RELATED APPLICATION

This application claims priority of Taiwanese Application No. 103120858, filed on Jun. 17, 2014.

FIELD

The disclosure relates to an electric device and a circuit device of the same, and more particularly to a light device for a ceiling fan, a switch device of the light device, and a method for preventing abnormal operation of the light device using the switch device.

BACKGROUND

In conventional designs, a ceiling fan with lights includes a light device mounted to a fan device, while the light device usually includes a metallic light board that is made from aluminum and that is connected to a neutral terminal of an AC (alternating current) power source, which is also connect to a neutral terminal of the fan device. However, when the light device is turned off and the fan device still operates, rotation of a motor of the fan device may induce a current noise flowing into the light device via the connection of the neutral terminal of the fan device and the metallic light board, resulting in abnormal illumination/flashing of the light device.

SUMMARY

Therefore, an object of the disclosure is to provide a light device that may alleviate the abovementioned abnormal operation.

According to the disclosure, the light device is adapted for use with a fan device. The fan device includes a fan operation module that has a fan neutral terminal for connection to a neutral terminal of an AC power source. The light device includes a light neutral terminal, a light line terminal, a light control unit and a switch device. The light neutral terminal is for connection to the neutral terminal of the AC power source and the first fan power terminal of the fan operation module. The light line terminal is for connection to a line terminal of the AC power source. The light control unit has a first terminal for electrical connection to the light neutral terminal, and a second terminal coupled to the light line terminal, and is configured for light emission upon receipt of the electrical power from said first and second terminals thereof. The switch device is coupled between the light neutral terminal and the first terminal of the light control unit, so as to make or break electrical connection therebetween.

Another object of the disclosure is to provide a switch device for preventing abnormal operation of a light device that is used with a fan device as attributed to operation of the fan device.

According to the disclosure, the switch device is adapted for use in a combination of a light device and a fan device. The fan device includes a fan operation module that has a fan neutral terminal for connection to a neutral terminal of an AC power source. The light device includes a light control unit for light emission according to electrical power from the neutral terminal and a line terminal of the AC power source. The switch device includes a switch unit and an optical coupling module. The switch unit is to be coupled between the fan neutral terminal and the light control unit, so as to make or break bidirectional electrical connection therebetween. The optical coupling module is disposed to receive electrical power from the AC power source, is coupled to the switch unit, and is configured to control the switch unit to break electrical connection in the absence of receipt of electrical power from the AC power source, and to make electrical connection by optical coupling when otherwise.

Yet another object of the disclosure is to provide a method for preventing abnormal operation of a light device that is used with a fan device as attributed to operation of the fan device. The fan device includes a fan operation module that has a fan neutral terminal for connection to a neutral terminal of an AC power source. The light device includes a light neutral terminal for connection to the neutral terminal of the AC power source and the fan neutral terminal, a light line terminal for connection to a line terminal of the AC power source, a light control unit for light emission upon receipt of electrical power from the light line terminal and the light neutral terminal, and a switch device coupled between the light neutral terminal and the light control unit.

According to the disclosure, the method includes the step of breaking, by the switch device, electrical connection between the light neutral terminal and the light control unit in the absence of electrical connection between the light line terminal and the line terminal of the AC power source.

BRIEF DESCRIPTION OF THE DRAWING

Other features and advantages of the disclosure will become apparent in the following detailed description of the embodiment with reference to the accompanying drawing, of which:

FIG. 1 is a schematic circuit diagram illustrating an embodiment of a light device for a ceiling fan according to the disclosure.

DETAILED DESCRIPTION

Referring to FIG. 1, the embodiment of a light device according to the present disclosure is adapted for use with a fan device (e.g., that of a ceiling fan, not shown). The fan device includes a fan operation module (e.g., a motor) 8 that has a fan neutral terminal 82 connected to a neutral terminal (N) of an AC (alternating current) power source (e.g., a domestic AC power supply, not shown), a fan line terminal 83 for connection to a line terminal (L) of the AC power source, and a fan power switch 84 coupled between the fan line terminal 83 and the line terminal (L). The light device includes a light neutral terminal 2 connected to the fan neutral terminal 82 and the neutral terminal (N), a light line terminal 3 for connection to the line terminal (L), a light emitting unit 4, a light control unit 5, a light power switch 7 coupled between the light line terminal 3 and the line terminal (L), and a switch device 6 configured to make or break electrical connection between the light neutral terminal 2 and the light control unit 5.

In this embodiment, the light emitting unit 4 includes a plurality of LEDs (light emitting diodes) coupled in series, but the disclosure is not limited thereto. The light control unit 5 has a first terminal for electrical connection to the light neutral terminal 2, and a second terminal coupled to the light line terminal 3, receives AC electrical power from the first and second terminals thereof, and is coupled to the light emitting unit 4 for controlling light emission thereof. In this embodiment, the light control unit 5 includes a full-bridge circuit 51 and a control circuit 52.

The full-bridge circuit 51 receives and rectifies the AC electrical power from the first and second terminals of the light control unit 5, thereby providing a DC electrical power to the control circuit 52. The control circuit 52 is coupled to the light emitting unit 4, receives the DC electrical power from the full-bridge circuit 51, and controls light emission of the light emitting unit 4.

The switch device 6 includes a switch unit 61, a filter module 62 and an optical coupling module 63. The switch unit 61 is coupled between the light neutral terminal 2 and the first terminal of the light control unit 5, so as to make or break bidirectional electrical connection therebetween.

In this embodiment, the switch unit 61 is a thyristor, and is more particularly a TRIAC (triode for alternating current, also called a triode AC semiconductor switch). The thyristor 61 has a first terminal 611 coupled to the first terminal of the light control unit 5, a second terminal 612 coupled to the light neutral terminal 2, and a control terminal 613 controlled to cause conduction or non-conduction between the first and second terminals 611, 612.

The filter module 62 is coupled to the light neutral terminal 2 and the light line terminal 3 for receiving AC electrical power from the AC power source, and is configured to filter and rectify the AC electrical power, and to output electrical power thus processed to the optical coupling module 63. The filter module 62 includes a diode 621 and a capacitor 622. The diode 621 has an anode coupled to the light neutral terminal 2, and a cathode. The capacitor 622 is coupled between the cathode of the diode 621 and the light line terminal 3.

The optical coupling module 63 is coupled to the filter module 62, and receives the electrical power processed by the filter module 62 to control the thyristor 61 to make or break electrical connection by optical coupling. The optical coupling module 63 includes a light emitting component 631 and a photosensitive component 632. In this embodiment, the light emitting component 631 is an LED, and the photosensitive component 632 is a DIAC (diode for alternating current).

The light emitting component 631 is coupled between two terminals of the capacitor 622 to receive the processed electrical power, to thereby emit or not emit light according to a voltage there across.

The photosensitive component 632 is disposed in correspondence to the light emitting component 631 for receiving the light emitted thereby, is coupled between the first terminal 611 and the control terminal 613 of the thyristor 61, bidirectionally conducts to cause conduction between the first and second terminals 611, 612 of the thyristor 61 upon receipt of the light emitted by the light emitting component 631, and does not conduct to cause non-conduction between the first and second terminals 611, 612 of the thyristor 61 when otherwise (i.e., when the light emitting component 631 does not emit light).

In application, when a user turns on the light device, the light power switch 7 is closed, and a voltage between the light neutral terminal 2 and the light line terminal 3 is higher than a predetermined value, thereby causing the diode 621 to conduct. Then, the light emitting component 631 emits light that causes the photosensitive component 632 to conduct, resulting in conduction of the thyristor 61. Accordingly, electrical connection between the light neutral terminal 2 and the first terminal of the light control unit 5 is established, and the light control unit 5 receives the AC electrical power to enable light emission by the light emitting unit 4.

When the user turns off the light device, the light power switch 7 is open), so that the light control unit 5 is unable to receive the AC electrical power, and light emission by the light emitting unit 4 is disabled. At this time, the voltage between the light neutral terminal 2 and the light line terminal 3 is not higher than the predetermined value, thereby causing the diode 621 to not conduct. The light emitting component 631 does not emit light so that the photosensitive component 632 does not conduct, resulting in non-conduction of the thyristor 61, and electrical connection between the light neutral terminal 2 and the first terminal of the light control unit 5 is broken. Accordingly, even if the ceiling fan still operates (i.e., the fan power switch 84 is closed), the current noise of the fan operation module 8 is unable to flow into the light control unit 5 through connection between the fan neutral terminal 82 and the light neutral terminal 2 since the thyristor 61 that interconnects the light neutral terminal 2 and the light control unit 5 does not conduct, thereby preventing abnormal illumination/flashing of the light device.

In summary, the embodiment has the following advantages:

1. By virtue of the switch device 6, electrical connection between the light neutral terminal 2 and the light control unit 5 is broken when the light device is turned off, thereby avoiding transmission of the current noise from the fan operation module 8 to the light control unit 5 via the connection between the fan neutral terminal 82 and the light neutral terminal 2, and preventing abnormal illumination/flashing of the light device.

2. The light emitting component 631 and the photosensitive component 632 may further isolate the abovementioned current noise induced by operation of the fan operation module 8 (e.g., rotation of the motor).

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A light device adapted for use with a fan device, the fan device including a fan operation module that has a fan neutral terminal for connection to a neutral terminal of an alternating current (AC) power source, said light device comprising:

a light neutral terminal for connection to the neutral terminal of the AC power source and the first fan power terminal of the fan operation module;

a light line terminal for connection to a line terminal of the AC power source;

a light control unit having a first terminal for electrical connection to said light neutral terminal, and a second terminal coupled to said light line terminal, and configured for light emission upon receipt of the electrical power from said first and second terminals thereof; and a switch device configured to make or break electrical connection between said light neutral terminal and said first terminal of said light control unit.

2. The light device according to claim 1, wherein said switch device is further coupled to said light line terminal, and is configured to break electrical connection in the absence of an electrical connection between said light line terminal and the line terminal of the AC power source, and to make electrical connection when otherwise.

3. The light device according to claim 2, wherein said switch device includes:

a switch unit coupled between said light neutral terminal and said first terminal of said light control unit, so as to make or break electrical connection therebetween; and an optical coupling module coupled between said light neutral terminal and said light line terminal for receiving the electrical power from the AC power source, coupled to said switch unit, and configured to control said switch unit to break electrical connection in the absence of an electrical connection between said light line terminal and the line terminal of the AC power source, and to make electrical connection by optical coupling when otherwise.

4. The light device according to claim 3, wherein said switch unit is a thyristor having a first terminal coupled to said first terminal of said light control unit, a second terminal coupled to said light neutral terminal, and a control terminal, and said optical coupling module includes:

a light emitting component coupled between said light neutral terminal and said light line terminal, and configured to emit light according to a voltage there across; and a photosensitive component coupled between said first terminal and said control terminal of said thysistor, and configured to conduct upon receipt of light emitted by said light emitting component, and to not conduct when otherwise.

5. The light device according to claim 4, wherein said photosensitive component is a diode for alternating current (DIAC), and said thyristor is a triode for alternating current (TRIAC).

6. The light device according to claim 3, wherein said switch device further includes a filter module coupled to said light neutral terminal and said light line terminal for receiving AC electrical power from the AC power source, and configured to filter and rectify the AC electrical power, and to output electrical power thus processed to said optical coupling module.

7. The light device according to claim 1, wherein said light control unit includes:

a full-bridge circuit coupled between said first and second terminals of said light control unit, and configured to, when said switch device makes electrical connection, rectify the electrical power received from said first and second terminals of said light control unit, so as to output a DC voltage; and a control circuit coupled to said full-bridge circuit for receiving the DC voltage therefrom, and configured to output a driving signal;

said light device further comprising a light emitting unit coupled to said control circuit for receive the driving signal therefrom, and configured to emit light according to the driving voltage.

8. A switch device adapted for use in a combination of a light device and a fan device, the fan device including a fan operation module that has a fan neutral terminal for connection to a neutral terminal of an alternating current (AC) power source, the light device including a light control unit for light emission according to electrical power from the neutral terminal and a line terminal of the AC power source, said switch device comprising:

a switch unit to be coupled between the fan neutral terminal and the light control unit, so as to make or break bidirectional electrical connection therebetween; and an optical coupling module disposed to receive electrical power from the AC power source, coupled to said switch unit, and configured to control said switch unit to break electrical connection in the absence of receipt of electrical power from the AC power source, and to make electrical connection by optical coupling when otherwise.

9. The switch device according to claim 8, wherein said switch unit is a thyristor having a first terminal to be coupled to the light control unit, a second terminal to be coupled to the fan neutral terminal, and a control terminal, and said optical coupling module includes:

a light emitting component to be coupled between the neutral terminal and the line terminal of the AC power source, and configured to emit light according to a voltage there across; and a photosensitive component coupled between said first terminal and said control terminal of said thyristor, and configured to bidirectionally conduct upon receipt of light emitted by said light emitting component, and to not conduct when otherwise.

10. The switch device according to claim 9, wherein said photosensitive component is a diode for alternating current (DIAC), and said thyristor is a triode for alternating current (TRIAC).

11. The switch device according to claim 8, further comprising a filter module to be coupled to the neutral terminal and a line terminal of the AC power source for receiving AC electrical power therefrom, and configured to filter and rectify the AC electrical power, and to output electrical power thus processed to said optical coupling module.

12. A method for preventing abnormal operation of a light device that is used with a fan device as attributed to operation of the fan device, the fan device including a fan operation module that has a fan neutral terminal for connection to a neutral terminal of an alternating current (AC) power source, the light device including a light neutral terminal for connection to the neutral terminal of the AC power source and the fan neutral terminal, a light line terminal for connection to a line terminal of the AC power source, and a light control unit for light emission upon receipt of electrical power from the light line terminal and the light neutral terminal, said method comprising the steps of:

coupling a switch device between the light neutral terminal and the light control unit; and breaking, by the switch device, electrical connection between the light neutral terminal and the light control unit in the absence of electrical connection between the light line terminal and the line terminal of the AC power source.

* * * * *